United States Patent [19]
Vela
[11] 4,258,873
[45] Mar. 31, 1981

[54] MACHINE AND METHOD FOR STAPLING DOOR FAMES

[76] Inventor: Charles C. Vela, 510 E. Gladstone, Apt. 3I, Azusa, Calif. 91702

[21] Appl. No.: 921,791

[22] Filed: Jul. 3, 1978

[51] Int. Cl.[3] ..... B27F 7/14
[52] U.S. Cl. ..... 227/4; 144/309 L; 227/30; 227/40; 227/100; 269/41
[58] Field of Search ..... 144/309 L; 227/4, 30, 227/40, 99, 100; 26.9/41, 42, 111

[56] References Cited

U.S. PATENT DOCUMENTS

| | | | |
|---|---|---|---|
| 2,482,872 | 9/1949 | Rapport | 227/30 |
| 3,591,067 | 7/1971 | Vail | 227/4 |
| 3,804,316 | 4/1974 | Ray | 227/40 |

FOREIGN PATENT DOCUMENTS

| | | | |
|---|---|---|---|
| 2152832 | 4/1973 | Fed. Rep. of Germany | 269/41 |
| 2453198 | 5/1975 | Fed. Rep. of Germany | 269/41 |
| 2413308 | 10/1975 | Fed. Rep. of Germany | 269/41 |

*Primary Examiner*—Paul A. Bell
*Attorney, Agent, or Firm*—Victor C. Muller

[57] ABSTRACT

Machine and method of stapling mitered joint frame members of rectangular cabinet doors and the like characterized by corner abutments or v-blocks for moving the joints together, and while clamped thereat, simultaneously applying a staple across each joint at both sides of the frame members. V-blocks may be adjusted for all size frames within its capacity. After placing four frame members on the v-blocks, a control effects automatic operation.

15 Claims, 11 Drawing Figures

18
13
44
23
22
43
35
46
47
22
42
45
41
40
49
48
37
36
39
38

MACHINE AND METHOD FOR STAPLING DOOR FAMES

BACKGROUND OF THE INVENTION

Cabinet doors as employed in mobile homes and the like are conventionally constructed of wood frame members adjacent their edges to which veneer is glued to opposite faces thereof. The frame members, usually four in number, and most frequently disposed in 90° relationship, are provided with mitered joints which, prior to applying the veneer, are stapled together with a staple bridging each joint at both sides of the frame members. The purpose of the staples is to hold the mitered joints in abutting relationship and the frame members in proper angular relationship during handling, storing, and passage through glue coating apparatus just prior to application of a veneer to each side and stacking in a glue press. Thereafter, the staples no longer serve any essential purpose, since the glued veneer on both faces of the frame members provides the structural bond therebetween. Edges of the doors, are often routed to form a detail such as cove, ogee, etc. to enhance appearance. It is essential, accordingly, that no staples be present in the path of the detail cutter. They are, accordingly, located closely adjacent the inside corners of the frame.

In the application of the staples, it is common practice to lay the frame members on a flat surface with the joints abutting and sequentially apply a staple across each joint with a hand-held power operated staple gun containing a magazine of staples. After these are applied, the frame is turned over and the operation repeated.

Disadvantages of this stapling process are that it is not only relatively slow, since the staples are sequentially applied by hand manipulation, but also subject to misalignment of the mitered joints. The process, accordingly, is subject to economies of manufacture and improvements in quality of the finished door.

Machines for clamping mitered joints together while fastenings are applied thereto have been proposed, such as exemplified by U.S. Pat. No. 2,482,872 to Rapport, where nails are driven across the mitered joints of picture frames from the outsides thereof. As previously referred to, no metal fastenings can be tolerated in such locations in cabinet doors with detailed edges. Thus, staples bridging the mitered joints near their inside corners have been the only commercially practical temporary fastener for the purpose required.

SUMMARY OF THE INVENTION

The present invention obviates the disadvantages referred to by simultaneously maintaining all mitered joints together and the frame members in proper angular relationship while applying the staples. While so maintained, all staples are simultaneously driven across the joints at both sides of the frame.

Assuming that the door is rectangular with two pairs of 45° mitered wood frame members of different length, which will hereafter be referred to as sides and ends, the stapling machine is adjusted so that a pair of 90° v-blocks on a stationary member receive a side member therebetween. A movable carriage having like v-blocks is adjusted in like manner to receive the other side member. The end members are then disposed on the v-blocks and the carriage moved toward the stationary member. As it moves to final position, all joints abut and wedge against each other to constrain the members to precise angular shape. While so clamped, staple guns above and below each joint are simultaneously actuated to drive eight staples extending across or bridging the joints.

Consonant with the foregoing, accordingly, a principal object of the invention is to provide a machine for simultaneously stapling mitered joint door frame members together across all joints and at opposite faces thereof, while maintaining all joints in abutting and accurate clamped angular relationship.

Another object is to provide the machine with adjustments for stapling frames of different sizes.

Another object is to provide controls for the machine which operate sequentially in response to certain sensing conditions.

A further object is to provide an improved method of stapling mitered joints of a door frame.

Still further objects, advantages and salient features will become more apparent from the detailed description to follow, the appended claims, and the accompanying drawing, to now be briefly described.

DETAILED DESCRIPTION OF PREFERRED EMBODIMENTS

Figure 1A:
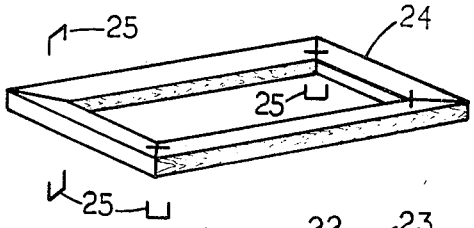
FIG. 1A illustrates a frame which has been stapled by the machine in FIG. 1.
Figure 1:
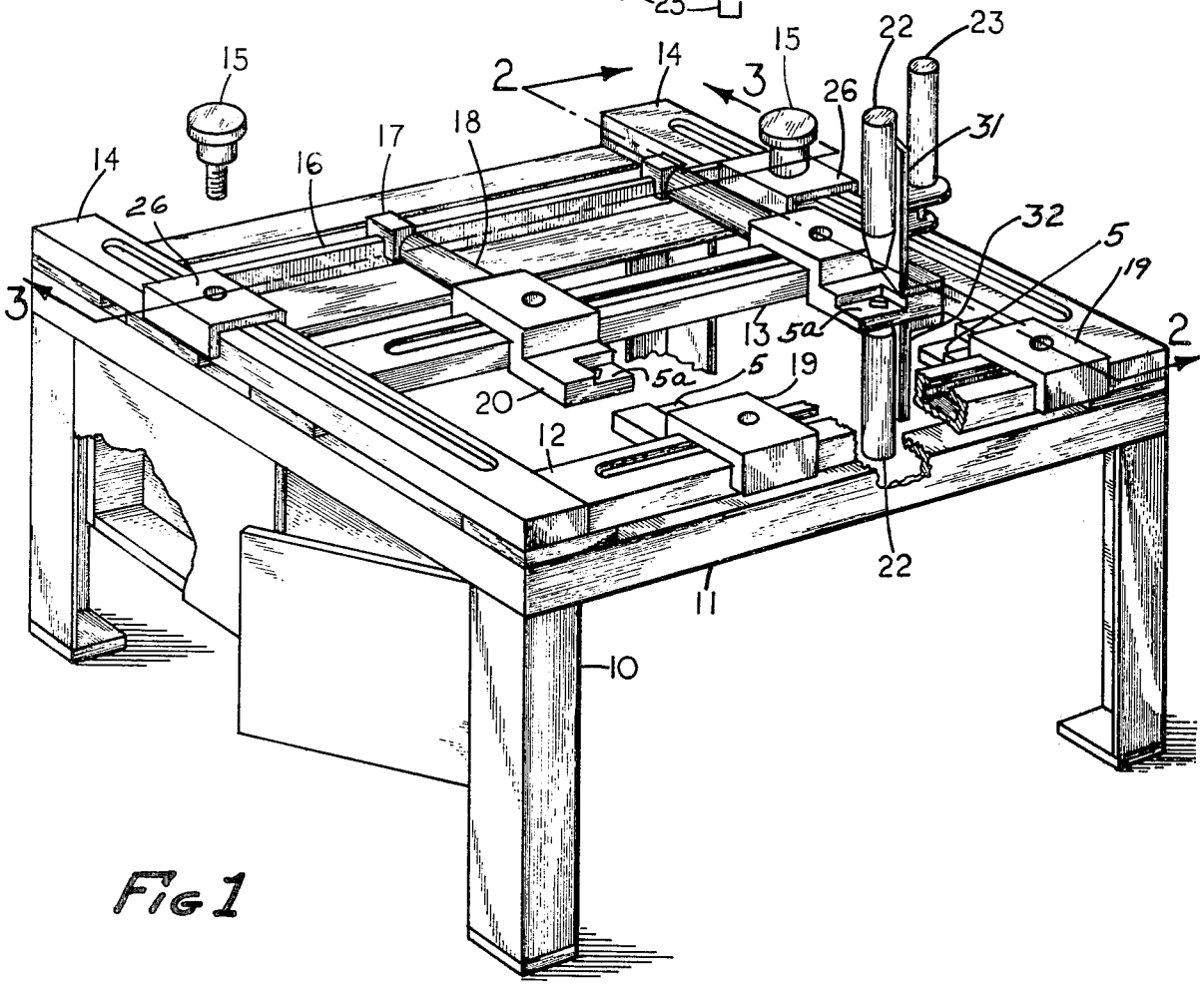
FIG. 1 is an isometric illustration of the subject of the invention, certain repetetive portions being omitted.
Figure 4:
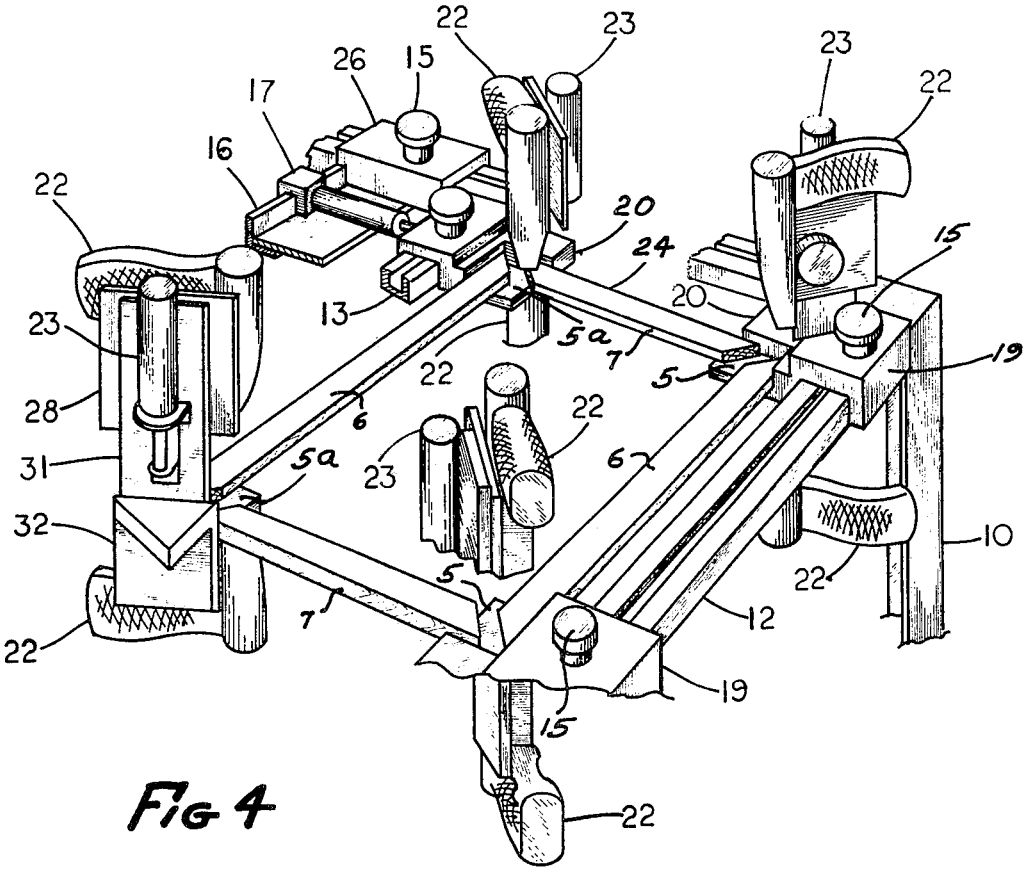
FIG. 4 is an isometric similar to FIG. 1 but as viewed angularly downwardly, illustrating certain parts omitted in FIG. 1.
Figure 5:
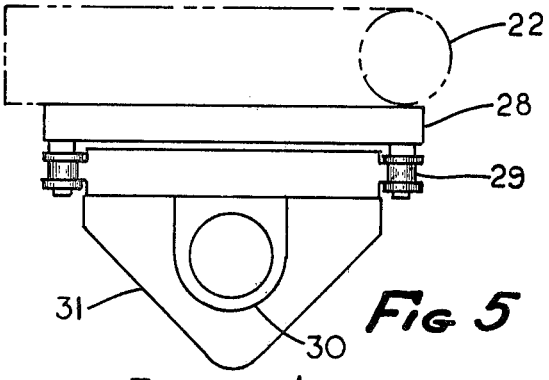
FIG. 5 is a plan of an upper staple gun mount.
Figure 6:
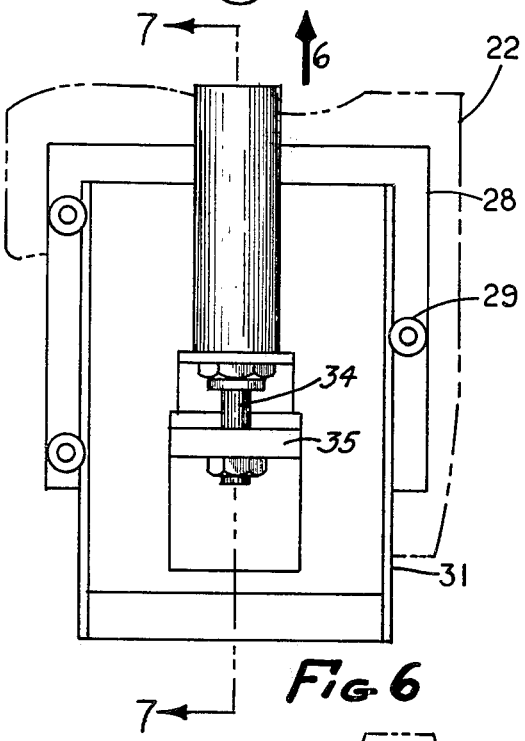
FIG. 6 is an elevation as viewed in the direction of arrow 6, FIG. 5.
Figure 7:
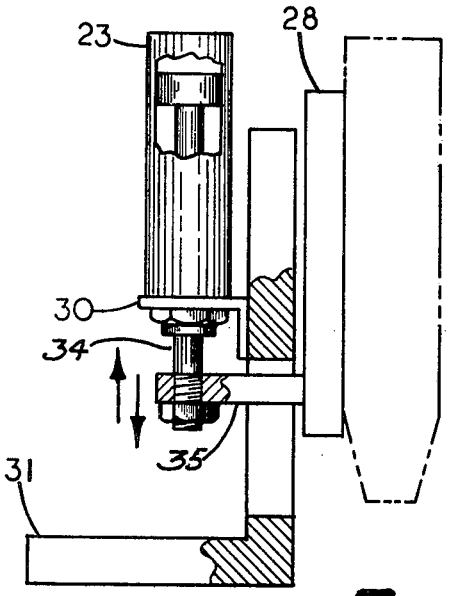
FIG. 7 is a section taken on line 7—7, FIG. 6, portions being broken away.

Referring not to the drawing in detail, and first to FIGS. 1 and 4, the subject of the invention comprises, briefly, a first pair of 90° frame corner abutments of v-blocks 5,5 mounted on a stationary rail 12 and along which they may be adjusted, and a second pair of like v-blocks *5a,5a* adjustable in like manner mounted on a rectilinearly movable rail or carriage 13. As best illustrated in FIG. 4, the pairs of v-blocks are adjusted to receive identical side frame members 6,6 with the carriage spaced from the stationary v-blocks, as illustrated. Identical end frame members 7,7 are then disposed on the v-blocks and the carriage moved toward the stationary v-blocks. As it moves to limit position, the corresponding mitered ends of the frame members engage each other with wedging action, clamping them together with each frame member disposed at a precise 90° to its adjacent frame member. Eight staple guns 22, one for each joint, above and below same, are then simultaneously fired, driving the staples in bridging relation across the joints. To ensure that all outside corners of the frame members exactly register, it is apparent that the side members 6,6, particularly, be formed to identical overall length and the v-blocks be adjusted to such length. Each pair of corner outer ends of the frame members will then be forced into registry without lap thereof.

More particularly, and as illustrated by way of example, all parts of the apparatus are supported by a rectangular frame 11, supported by legs 10. Stationary bar or rail 12 is rigidly secured to the frame and may be constructed of box-shaped tubing with a longitudinal slot in its upper face and along which v-block supports or carriers 19,19 are slidably mounted and each secured in desired position therealong by a screw 15 and nut 27 to thus space the v-blocks apart a distance equal to the overall length of a side frame member 6.

Figure 2:
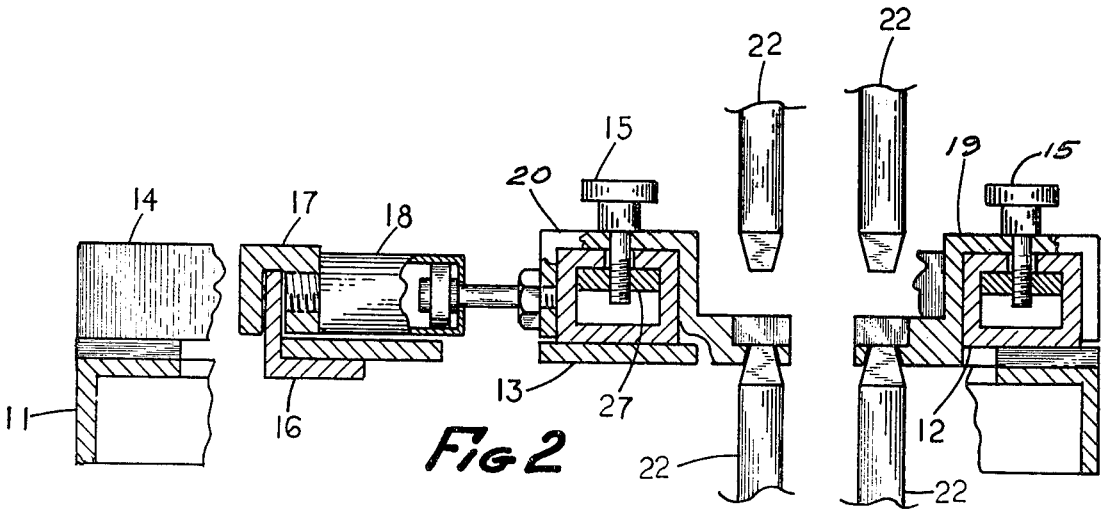
FIG. 2 is a section taken on line 2—2, FIG. 1.
Figure 3:
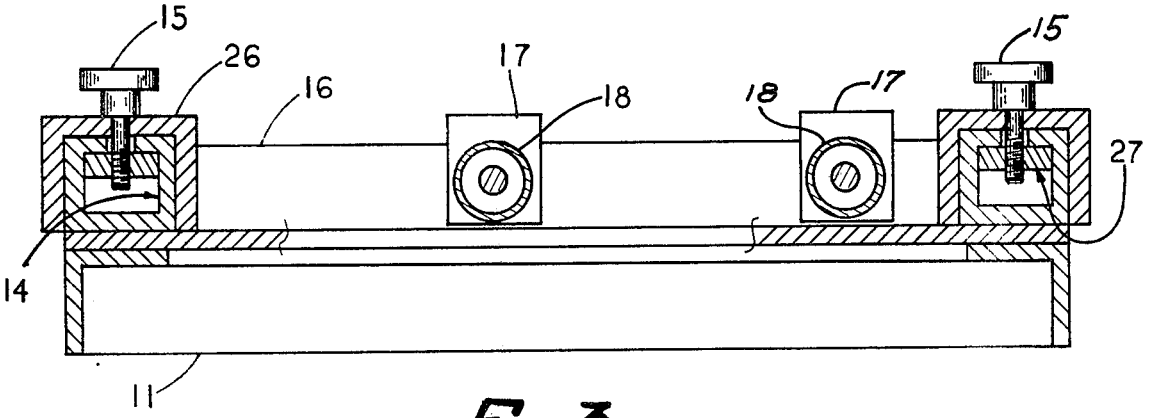
FIG. 3 is a section taken on line 3—3, FIG. 1.

Clamp bar or carriage 13 is constructed in like manner but differs in that it is rectilinearly movable toward and away from the fixed bar 12 and v-blocks 5,5 affixed thereto. A pair of spaced double acting pneumatic actuators 18,18 are connected between the carriage and a rail 16, the ends of which may be adjusted along side rails 14,14 constructed in the same manner as rail 12 and clamped thereto by clamps 26,26. As best shown in FIG. 2, each actuator is secured at one end to bar 16 by an adjustable channel block 17, its piston rod being connected to a v-block carrier 20. As will be apparent, the carriage v-blocks may be adjusted in the same manner as the stationary v-blocks and bar 16 may be adjusted so that the carriage v-blocks are spaced a desired distance from the fixed v-blocks. This distance will be somewhat in excess of the overall length of side frame members 7,7.

Figure 8:
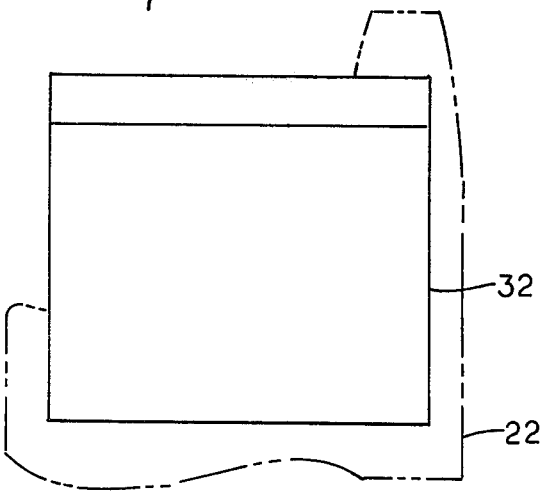
FIG. 8 is a rear elevation of a lower staple gun mount.
Figure 9:
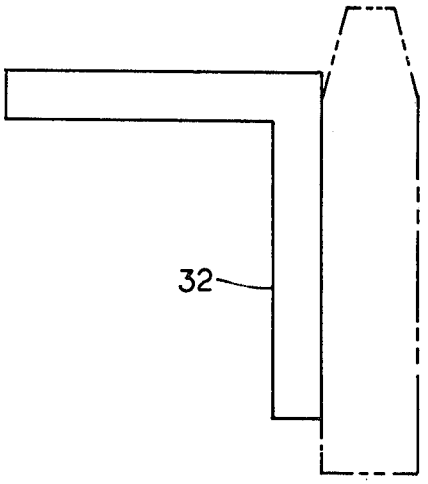
FIG. 9 is a side elevation of FIG. 8.

The v-block carriers 19,19 and 20,20 each support a fixed lower staple gun and a movable upper staple gun, a description of one pair of which will suffice for all. As best shown in FIGS. 1, 8 and 9, a lower staple gun 22 is affixed to a v-block carrier by an angle bracket 32. As best shown in FIGS. 1 and 5–7, an angle bracket 31 is also affixed to the top of a v-block carrier, which supports a double acting pneumatic actuator 23, affixed to bracket 31 by an angle bracket 30. A plate 28, to which an upper staple gun 22 is affixed, supports grooved rollers 29 which roll along tongues at the vertical edges of bracket 31. Piston rod 34 is connected to plate 28 by a connector 35. As will be apparent, each upper staple gun is thus supported by a machine guide for rectilinear vertical movement.

In the operation of the apparatus and after manually adjusting the distance between the v-blocks to the length of the side frame members and the spacing of the carriage so that the end frame members are spaced from the side members, a single control is actuated and sequence of operation is as follows:

1. Carriage moves to clamping position, all mitered joints abutting thereat.
2. Upper staple guns move into engagement with corners of frame members.
3. Staple guns fire simultaneously.
4. Upper staple guns return to retracted positions.
5. Carriage returns to loading position for removal of stapled frame and reloading, the stapled frame 24 with eight staples 25 being illustrated in FIG. 1A.

Figure 10:
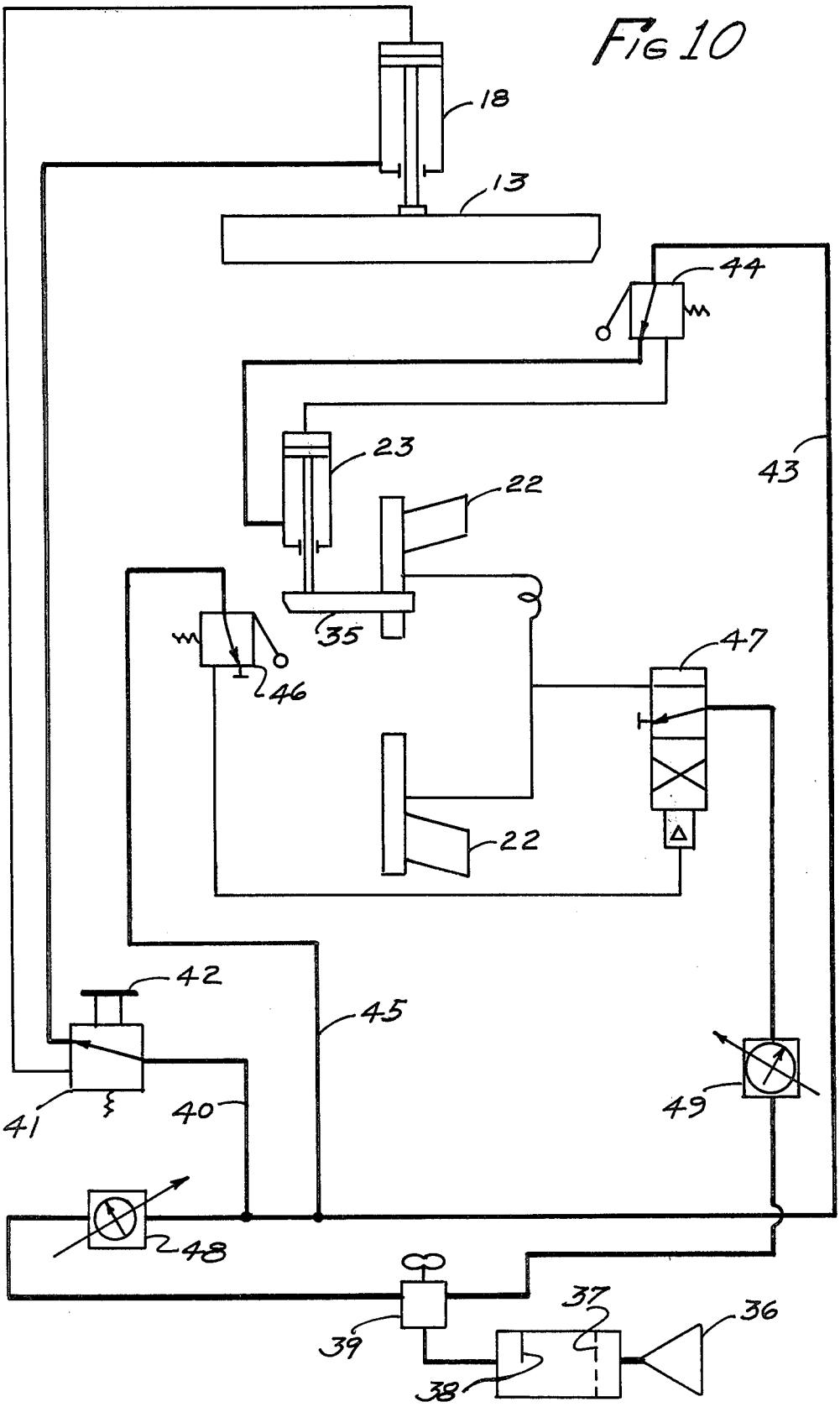
FIG. 10 diagrammatically illustrates a machine operation control system.

The manner in which such operation is attained will become apparent from FIG. 10 which diagrammatically illustrates the various controls. Air supply line 36 is provided with an air filter 37, lubricator 38 and main manual shut-off valve 39, all of which are conventional in air operated instrumentalities. To simplifiy the drawing, only one carriage actuator 18 has been illustrated, it being understood that a second actuator communicating in parallel is employed. Also, only one pair of staple guns are illustrated, it being understood that four pairs are employed, one pair for each corner of the frame.

A first branch line 40 is provided with a two position three-way valve 41 operated by a spring loaded control button 42 and connected to opposite sides of double acting actuator 18. When the button is depressed, pressurized air in the lower end of the actuator exhausts to atmosphere and the upper end is pressurized, moving the carriage to clamping position. Upon release of the button the carriage returns to retracted position.

A second branch line 43 is connected to upper gun double acting actuator 23 which is controlled by a spring return cam operated three-way valve 44 which is engaged by the carriage 13 when it moves to clamping position. When the cam opens the valve, air in the lower part of actuator 23 exhausts to atmosphere and the upper end of the actuator is pressurized, moving the gun to frame engaging position. Return of the carriage permits the valve to move to its other position, causing the actuator to retract.

A third branch line 45 is opened or closed by a cam operated valve 46, which opens in response to movement of the actuator to frame engaging position. When this valve opens, air is supplied to a conventional pilot operated time delay valve 47 which supplies a momentary burst of air to the staple guns.

A pressure regulator 48 controls branch line pressures and a like regulator 49 controls pressure to the staple guns.

In summary, control button 42 is depressed and maintained thereat. The carriage moves to clamping position at which it commands the top gun actuators to move to frame engaging positions. As one moves to such position it controls a valve which provides a momentary supply of air to all staple guns. The control button is then released, which causes the upper guns to retract and the carriage to return to its open or loading position. The entire cycle occurs in approximately two seconds.

In the apparatus, as so far described, the v-blocks are disposed at the corners of a rectangle and each has an included angle of 90°. Nearly all doors are quadrilaterals of which most are rectangles with a minority of squares. Other quadrilaterals are: parallelogram, trapezium, and trapezoids, which include rectangular trapezoid, isosoles trapezoid and trapezoids with non-equiangular ends of other than 90°. Of these door shapes, most are seldom used except the rectangular trapezoid wherein the angular end might be employed to fit a sloping roof or the like. The demand for all is relatively small and generally would not warrant setting up a machine for a production run. On the contrary, the frames would be hand stapled in the conventional manner. If the demand were sufficient to warrant a machine set up, however, frames of any of those shapes could be stapled within the purview of the invention. As an example, the stationary v-blocks would remain as illustrated and the v-blocks on the carriage would be formed with an angle other than 90°, one an acute and the other obtuse with a total included angle of 180°. This would thus produce the rectangular trapesoid which is occasionally used. From this example, it will be apparent that the stationary v-blocks could also be formed as other than 90° and arranged to clamp any of the quadrilaterals referred to.

All valves employed are conventional and commercially available. The staple guns are also commercially available such as the type furnished by Spotnails, Inc. of Rolling Meadows, Ill., model LOM 58, which operates with a spiral cartridge of 3000–5000 straight wires which are bent to staple shape when delivered therefrom, this type being preferred due to its less frequent requirement for staple reloading.

What is claimed is:

1. In a method of assembling a rectangular door including a pair of like parallel wooden side frame members and a like pair of wooden end frame members, the members all being rectangular in cross section and having like mitered ends, and arranged in quadrature to form a rectangular frame having opposite flat faces and adjacent abutting mitered ends, said method comprising (A) applying at least one staple extending across adjacent mitered ends perpendicular to the plane of the frame, (B) coating the opposite flat faces of the frame with glue or the like, and (C) retaining flat panels on the opposite faces of the frame under pressure until the glue sets, the improvements in combination with (B) and (C), aforesaid, wherein said method (A) comprises:

(a) supporting the members in planar quadrant relationships with their ends disposed between four v-blocks with the mitered ends spaced apart;

(b) moving the v-blocks relatively to force the ends together in abutting clamped relationship; and (c) simultaneously driving at least one staple across each mitered joint substantially perpendicular to the plane of the members while so clamped.

2. A method in accordance with claim 1 wherein the staples are driven adjacent the inner corners of the frame members at positions out of the path of a routing cutter which may remove outer edges of the frame members.

3. A method in accordance with claim 1 wherein two staples are driven across each mitered joint, one at each side thereof.

4. Apparatus for stapling together the mitered ends of four wooden door frame members, such as employed adjacent the peripheral edges of cabinet doors and the like, and the opposite faces of which veneer panels are subsequently secured, comprising;

(a) means for supporting the frame members in planar quadrature relationship with the mitered ends spaced apart, (b) means for moving the frame members relatively and forcing adjacent mitered ends into abutting and clamped relationship, (c) a power operated staple gun adjacent each mitered joint affixed to the apparatus for driving at least one staple into the frame members across each mitered joint substantially perpendicular to the plane thereof while so clamped.

(d) means for substantially simultaneously operating the staple guns, (e) said support and moving means comprising four v-blocks, one for each pair of adjacent frame members, each adapted to wedge the mitered end of one frame member against the mitered end of the adjacent frame member, (f) two v-blocks being disposed in fixed position and the other two v-blocks being fixed to a rectilinearly movable carriage, and power means for moving the carriage toward and away from the fixed v-blocks, and (g) wherein the staple driving means comprises a pair of opposed pneumatic staple guns for each corner of the frame members, one being in engagement therewith at one side thereof and the other being movable toward and away therefrom at the other side thereof, the latter adapted to engage the frame members during driving of the staples.

5. Apparatus in accordance with claim 4 including means for automatically:

(a) moving the carriage to a limit position in which the v-blocks clamp the frame members together;

(b) moving movable staple guns into engagement with the frame members in response to movement of the carriage to limit position;

(c) actuating all staple guns to simultaneously drive staples into the frame members in response to movement of the movable staple guns into engagement with the frame members, and (d) returning the carriage to its original position for removal of the stapled frame members and reloading of a succeeding set thereof.

6. Apparatus in accordance with claim 4 wherein the distance between the fixed v-blocks may be adjusted and the distance between the movable v-blocks may be adjusted in like manner to thereby receive therebetween side frame members of various lengths, and means for adjusting the position of the carriage to receive end frame members of various lengths, the carriage position adjusting means comprising a rectilinearly adjustable bar, or like abutment, and the frame member moving means comprising a pair of pneumatic rectilinearly movable actuators disposed between the bar and the carriage, each actuator being affixed at one end to the bar and at the other end to the carriage in alignment with a v-block, whereby movement of the carriage is controlled by forces acting in alignment with the end members regardless of the length of the side members.

7. Apparatus for stapling together the mitered ends of four wooden door frame members comprising a pair of like parallel side members and a pair of like parallel end members, disposed in planar relationship and forming sides of a rectangle, comprising:

(a) a first pair of 90° v-blocks, at least one being rectilinearly adjustable toward the other, whereby a side member of desired length may be disposed therebetween and abutting same;

(b) a rectilinearly movable carriage having a like pair of adjustable v-blocks between which the other side member may be disposed in like abutting relationship;

(c) the end members adapted to be disposed between the v-blocks but with their mitered ends spaced from those of the side members;

(d) the construction being such that when the carriage is moved toward the first pair of v-blocks, the mitered ends of all adjacent members abut each other with a wedging action and are clamped together in 90° relationship with their outer ends aligned, forming a rectangular frame with the same dimensions of those of the side and end members;

(e) a power operated staple gun adjacent each mitered joint affixed to the apparatus for driving at least one staple into the frame members across each mitered joint substantially perpendicular to the plane thereof while so clamped;

(f) means for substantially simultaneously operating the staple guns after the carriage has moved the mitered ends to clamped relationship; and (g) said staple driving means comprising a pair of pnuematic staple guns for each joint, one being fixed below same and the other being movably mounted above same and adapted to be moved downwardly into abutting relationship therewith, and means for firing all staple guns when the movable staple guns abut the frame members.

8. Apparatus in accordance with claim 7 including pneumatic actuator means for moving the carriage in both directions of its movement.

9. Apparatus in accordance with claim 8 wherein the actuator means comprises a double acting cylinder for each v-block carried by the carriage, the actuators being so disposed to apply substantially equal pressures to the end members.

10. Apparatus in accordance with claim 8 including control means for:

(a) moving the carriage until limited by the end members;

(b) thence moving the upper staple guns into abutting relationship with the frame members;

(c) thence firing all staple guns;

(d) thence returning the upper staple guns to their original positions, and (e) thence returning the carriage to its original position.

11. In apparatus for assembling a rectangular door including a pair of like parallel wooden side frame members and a like pair of wooden end frame members, the members all being rectangular in cross section and having like mitered ends, and arranged in quadrature to form a rectangular frame having opposite flat faces and adjacent abutting mitered ends, said apparatus comprising;

(A) means for applying at least one staple extending across adjacent mitered ends perpendicular to a plane of the frame, (B) means for coating the opposite flat faces of the frame with glue or the like, and (C) means for retaining flat panels on the opposite faces of the frame under pressure until the glue sets, the improvements in combination with (B) and (C), aforesaid, wherein said means (A) comprises;

(a) means for supporting the frame members in planar quadrature relationship with the mitered ends spaced apart, (b) means for moving the frame members relatively and forcing adjacent mitered ends into abutting and clamped relationship, (c) a power operated staple gun affixed to the apparatus adjacent each mitered joint at one side of the frame members for driving a staple into the frame members across each mitered joint substantially perpendicular to the plane thereof while so clamped, and (d) means for substantially simultaneously operating the staple guns.

12. Apparatus in accordance with claim 11 including a like power operated staple gun affixed to the apparatus adjacent each mitered joint at the opposite side of the frame members for driving a second staple into the frame members across each mitered joint substantially perpendicular to the plane thereof, whereby the staples at each mitered joint are driven in directions toward each other.

13. Apparatus in accordance with claim 11 wherein the staple guns are arranged to drive the staples across each joint at a position closely adjacent the inner corner thereof.

14. Apparatus in accordance with claim 11 wherein the support and moving means comprises four v-blocks, one for each pair of adjacent frame members, each adapted to wedge the mitered end of one frame member against the mitered end of the adjacent frame member.

15. Apparatus in accordance with claim 14 wherein two v-blocks are fixed to a rectilinearly moveable carriage, and power means for moving the carriage toward and away from the fixed v-blocks.

* * * * *